United States Patent [19]

Rogers et al.

[11] Patent Number: 4,805,528

[45] Date of Patent: Feb. 21, 1989

[54] COTTON BALE RECOMPRESSING AND RETYING MACHINE AND PROCESS

[76] Inventors: Thomas A. Rogers, 5409 21st St., Lubbock, Tex. 79407; David H. Underwood, 3021 22nd St., Lubbock, Tex. 79410

[21] Appl. No.: 651,988

[22] Filed: Sep. 18, 1984 (Under 37 CFR 1.47)

[51] Int. Cl.[4] ..... B65B 13/20

[52] U.S. Cl. ..... 100/3; 100/11; 100/31; 206/83.5

[58] Field of Search ..... 100/3, 8, 11, 31, 32, 100/33 R, 34, 29; 206/83.5; 24/27, 28, 29; 140/73, 93 A, 93.6, 93 B

[56] References Cited

U.S. PATENT DOCUMENTS

| | | | |
|---|---|---|---|
| 233,603 | 10/1980 | Dederick | 206/83.5 |
| 577,511 | 2/1897 | Hayne | 206/83.5 |
| 4,120,238 | 10/1978 | Schafer et al. | 100/11 |
| 4,156,385 | 5/1979 | Lems et al. | 100/3 |
| 4,158,994 | 6/1979 | Jensen | 100/3 |
| 4,320,701 | 3/1982 | Donaldson | 100/3 |
| 4,459,904 | 7/1984 | Probst et al. | 100/11 |
| 4,676,153 | 6/1987 | Ast | 100/3 |

*Primary Examiner*—Andrew M. Falik

*Attorney, Agent, or Firm*—Charles W. Fallow; Martin P. Hoffman; Mitchell B. Wasson

[57] ABSTRACT

Loose cotton bales are compressed to about half their original size in a press having a lateral barrier with slots therein through which the original baling wires bulge outward, thus enabling automatic devices to engage the wires, apply tension thereto, and retie the wires to a shorter length.

10 Claims, 6 Drawing Sheets

COTTON BALE RECOMPRESSING AND RETYING MACHINE AND PROCESS

This invention relates to the art of recompressing loose cotton bales to form high density bales, and more particularly to a method and apparatus for achieving such recompression without removing the original baling wires.

BACKGROUND

Ginned cotton bales conventionally come from the gin in standard so-called "flat" bales measuring approximately 25×45×55 inches, tied around the shorter sides by 124-inch baling wires, and having a density of about 10–12 pounds per cubic foot. Since bales this size are considered too bulky for efficient transportation and handling, flat bales are normally compressed prior to shipping in a bale press. The bale press, applying a force of about four million pounds, reduces the 45 inch dimension by at least half to produce a compressed bale having over twice the density of the "flat" bale. Two old patents to S. J. Webb, Nos. 659,612 and 677,148, show bale presses typical of those still used today.

Flat bales are conventionally pressed and re-tied by the following procedures:

1. The flat bales (FIG. 1*a*) are first slightly compressed (FIG. 1*b*) in a small device called a "dinky" press. This reduces the height of the bale just enough to relieve tension on the 124-inch baling wires so that they can be severed by means of a hand-operated wire cutter. The wires are removed and set aside for re-use.

2. The bale covers are then tied with string to stabilize the bale while it is being transported to the press.

3. The flat bale is inserted between the top and bottom platens of a large press operated by a steam or hydraulic cylinder (FIG. 1*c*).

4. Two opposing pivoted doors are brought from an initial horizontal position to vertical, confining the bale within a twenty-four inch space equal to the width of the platens.

5. The platens are then drawn together with a force rising to approximately four million pounds (FIG. 1*d*), whereupon the original height of 45 inches is reduced to about twelve inches.

6. With the bale thus compressed, the doors are lowered back to horizontal (FIG. 1*e*), enabling workers standing on the doors to re-tie the compressed bale with shortened, straightened 84-inch wires (FIG. 1*g*) salvaged from step #1. The shortened wires are passed around the compressed bale through transverse grooves specially provided in the platens, as shown for example in FIG. 1 of the Webb U.S. Pat. No. 659,612 or in FIG. 1 of U.S. Pat. No. 4,320,701 to Donaldson. (The latter patent shows conventional loop ends used for uniting the ends of the baling wires. Looped connections fail suddenly, without slippage, and have approximately an 1800-pound load limit, even though the 10-gauge wires from which they are formed have 3000-pound strength.)

7. The wire salvage procedure is a significant subroutine involving steps of (a) cutting the wires to length, (b) straightening them in a machine, (c) forming new loops at the ends thereof, (d) bundling and transporting the wires to the bale press, and (e) disposing of excess.

The total labor force required to compress flat bales in a cotton warehouse is sixteen to eighteen workers (not counting those involved in handling and transporting the bales). Besides the press operator, at least four people are required to re-tie the bales. The others are engaged in operating the dinky press, installing string, or salvaging and reforming the baling wires. A substantial saving in labor costs could be realized by simplifying the retying and salvage operations. This has previously been noted. For example, Webb, in his U.S. Pat. No. 677,148, entitled "Method of Compressing Bales without Removing the Bands", recognized even in 1900 that considerable savings could be achieved by not having to replace the flat bale's original bands. (Today, bands have largely been replaced by 10-gauge wires.)

In view of today's higher labor costs, it is now even more desirable to reduce the still labor-intensive process of recompressing "flat" cotton bales.

A primary object of this invention is therefore to provide a machine for the cotton warehouse industry to re-tie cotton bales as they are being compressed for shipment, using the gin-installed tie wires without removing them from the bale at any time.

Another object of this invention is to provide a knot in each of the ties of the compressed re-tied bales that will yield slightly under excess tension without parting, thereby preventing the original gin installed knot from parting or snapping suddenly when the bale is dropped or swells.

A further object of this invention is to eliminate the necessity for workers to stand near or on moving parts of the press for the purpose of re-tying the bale, since the bales, as received from the gin, can be pressed and re-tied mechanically using this invention.

A further object is to reduce the number of operations that must be performed manually in the compression and re-tying of bales, thereby lowering the compression costs and making it easier to operate multiple shifts with fewer workers.

An important and useful discovery of this invention is the fact that pressure applied to conventionally ginned cotton bales sufficient to square the corners causes the wire ties to buckle outward in a column type elastic deflection that is uniform. This discovery is helpful in securing the wire so that the slack can be removed as the bale is being compressed.

SUMMARY OF THE INVENTION

This invention provides a method and apparatus for compressing and re-tying flat bales wherein the bale, with original wires intact, is placed in a press against a lateral barrier having vertical through-slots in registry with the baling wires. The bale is then compressed, whereupon the wires bow outwardly uniformly from the bale and through the slots. The protruding wire bights are engaged by corresponding pulleys, and as bale compression progresses, the pulleys are drawn away from the bale to maintain wire tension. Once the bale is fully compressed, the wire loop is secured at two points by clamps into which it has been drawn by the pulley. Subsequently, the loop is severed, the clamps draw the wire ends to a twist tie former, and a twist knot is formed. The compressed bale is then released from the press, the original wires having been tightened and re-tied without ever having been removed from the bale.

Some important advantages of this invention are as follows:

(1) This invention avoids the sequential tying of successive wires after the bale has been pressed. Instead, this invention provides as many independent stations as there are wires, thereby making possible the simultaneous tensioning and tying of all eight bale wires while the press is in operation. The production rate may thus be increased.

(2) This invention employs minimal additions and modifications to a conventional press, thereby avoiding time consuming, expensive, alterations to old and irreplaceable equipment.

(3) An important feature of this invention is the variability of the tension and number of twists that can be made in the twist type knot used to re-tie the wires. This variability of knot configuration is helpful in compensating for wire ties of different properties used in different areas or circumstances.

BRIEF DESCRIPTION OF THE DRAWINGS

Other objects and advantages will be apparent from the following description, taken in conjunction with the accompanying drawings, wherein.

DESCRIPTION OF THE PREFERRED EMBODIMENT

Figure 3:
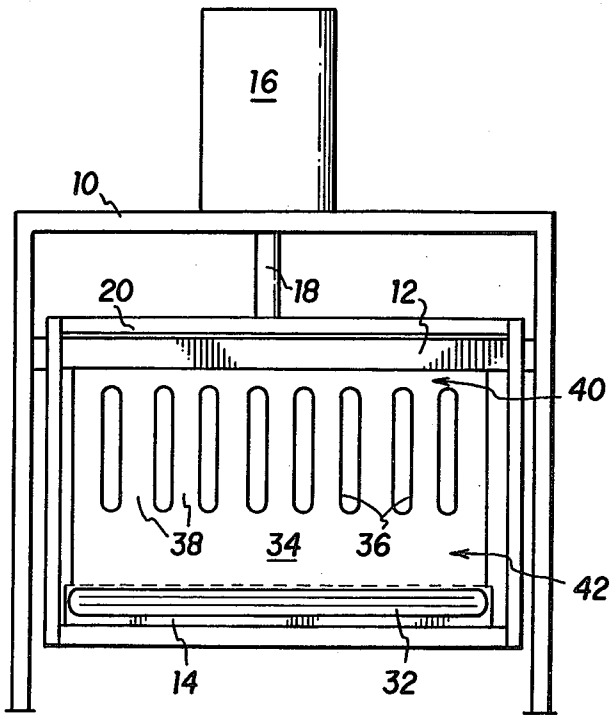
FIG. 3 is a right side elevation of the apparatus shown in FIG. 2.
Figure 2:
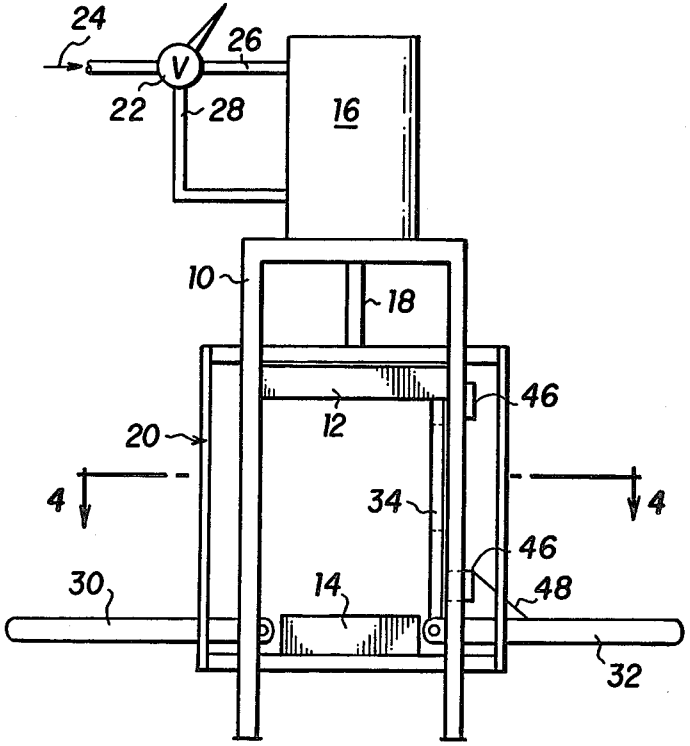
FIG. 2 is a front elevation of a cotton press embodying the invention, showing major components thereof in simplified form.

With reference to FIGS. 2 and 3, the invention is embodied in a cotton bale press comprising a frame 10 having an affixed upper platen 12, and a lower platen 14 vertically movable on the frame by means of a hydraulic or steam actuated cylinder 16. The piston rod 18 is connected to the lower platen via linkage 20, the direction of rod travel being determined by a reversible valve 22 connected between a source of fluid pressure 24 and respective pressure lines 26 and 28.

A conventional pivoted side door 30 is shown open on the left of FIG. 2. When open, this door would previously have provided footing for workers applying the ties; it may also be closed as shown in FIG. 5 to laterally confine the bale during compression. The opposite door 32 is permanently disabled in the open position when practicing this invention. The disabled door 32 supports a novel side barrier 34 permanently fixed in a vertical position closely adjacent the path of the lower platen, the space between the barrier 34 and the closed side door 30 being just sufficient to permit the lower platen to pass therebetween.

Figure 1B:
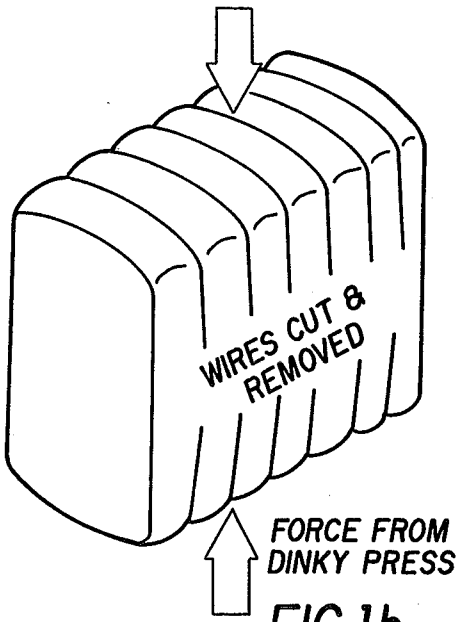
FIG. 1b PRIOR ART
FIGS. 1*a*–1*g* illustrates a current method of compressing and re-tying cotton bales.
Figure 1A:
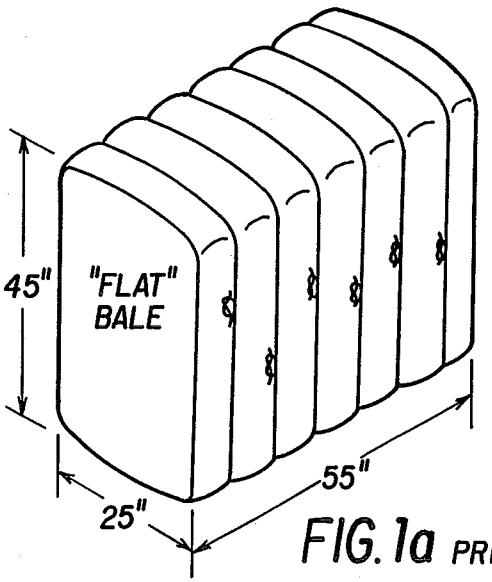
FIG. 1a PRIOR ART
Figure 1F:
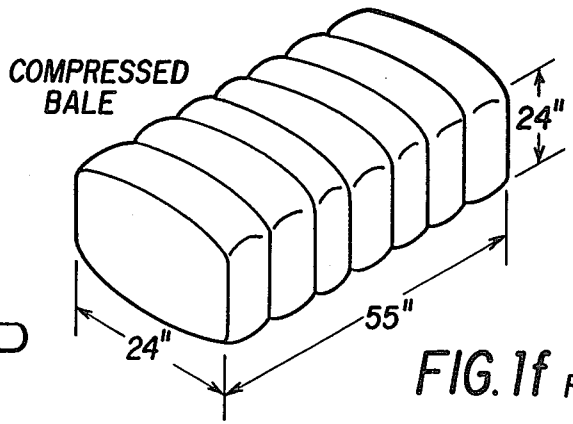
FIG. 1f PRIOR ART
Figure 1E:
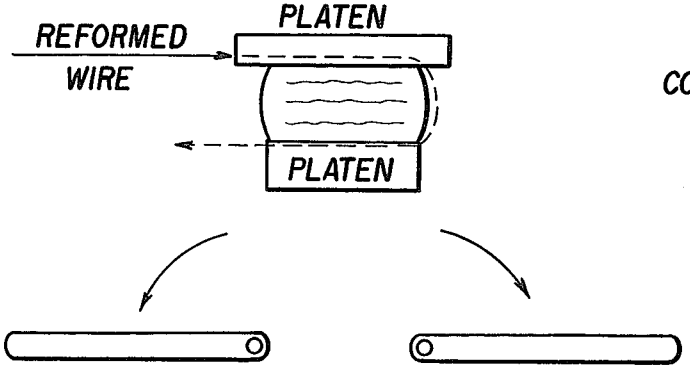
FIG. 1e PRIOR ART
Figure 4:
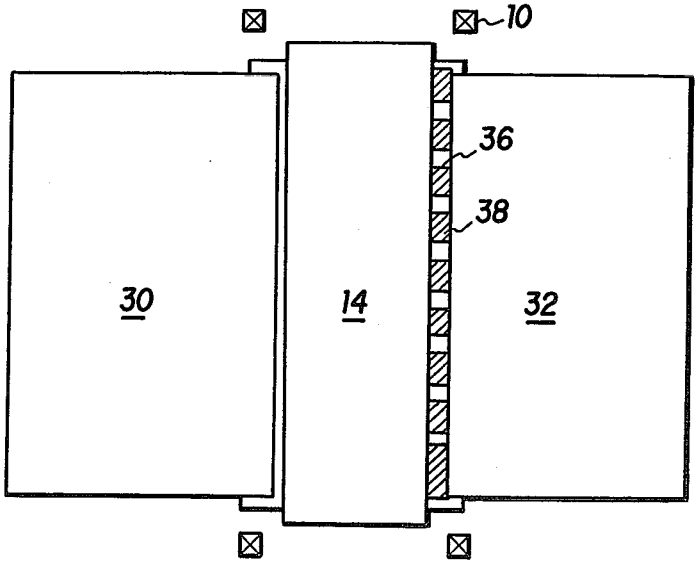
FIG. 4 is a horizontal cross-section taken along the line 4—4 in FIG. 2.
Figure 1D:
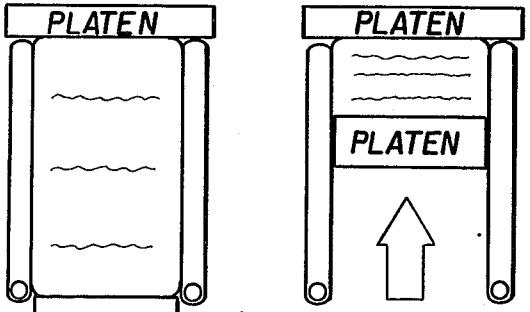
FIG. 1d PRIOR ART
Figure 1C:
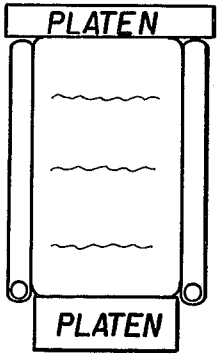
FIG. 1c PRIOR ART
Figure 1G:
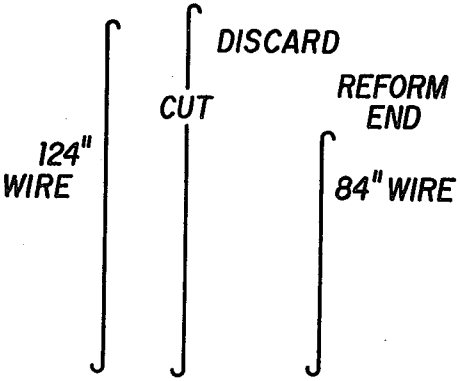
FIG. 1g PRIOR ART

The barrier 34, shown in section in FIG. 4, comprises a plate having eight vertical through slots 36 extending not quite the full heighth of the plate so that the pickets 38 remaining between the slots are interconnected by top and bottom portions 40 and 42. The barrier 34 is laterally supported at top and bottom by individual brace beams 46, the lower of which is in turn joined to the disabled door 32 by beam support brackets 48.

Figure 6:
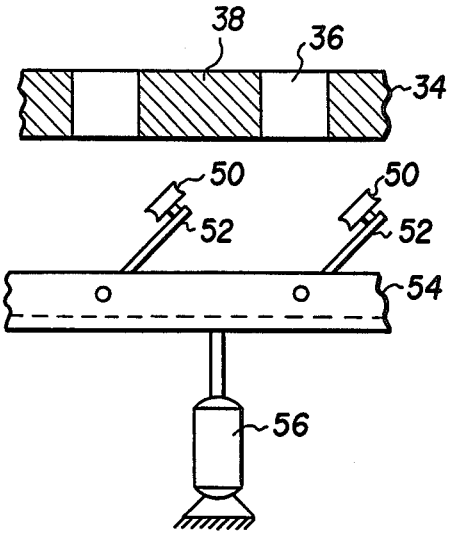
FIG. 6 is a detailed view of a pulley shown in FIGS. 5*a*–5*c;*

Referring now to FIG. 6, the apparatus also includes means for engaging and tensioning the baling wires during bale compression, preferably in the form of a series of pulleys 50, each rotatably mounted along a horizontal axis on an arm 52 that is in turn pivotally supported on a vertical axis upon a pulley support 54. The pulley support is movable horizontally away from the barrier slots 36, and suitable means for moving the pulley support away from the slots, such as a hydraulic linear motor 56, is provided.

Figure 5A:
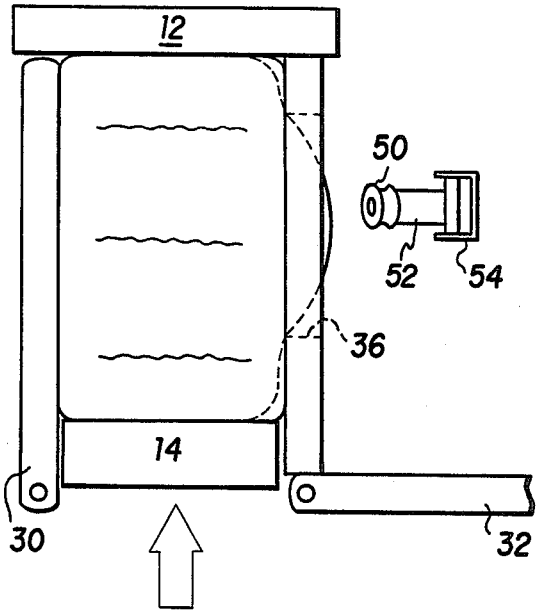
FIGS. 5*a*–5*c* are views corresponding to FIG. 2, with a flat bale in place and in various stages of compression.
Figure 5B:
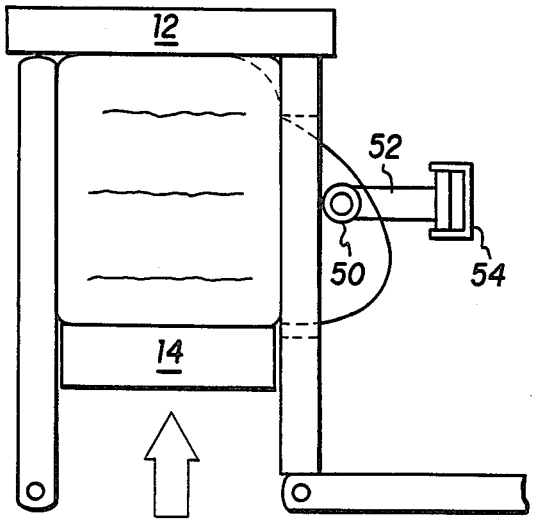
Figure 5C:
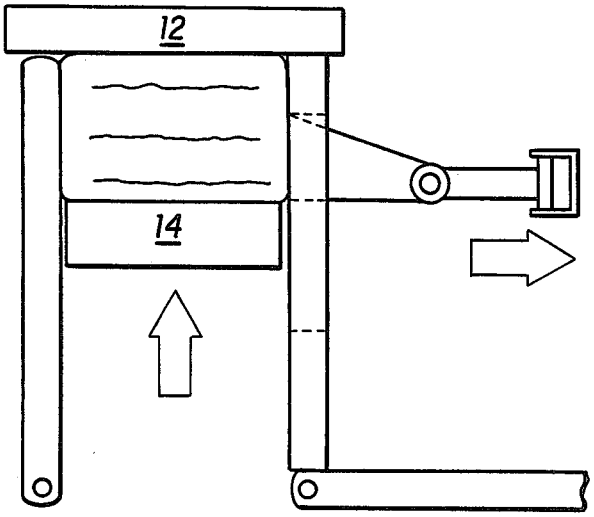

Operation of the structure discussed to this point is illustrated in FIGS. 5*a*–5*c*. The bale is initially oriented with its wire knots oriented toward the door 30. (Obviously, the bale wire positions must correspond in spacing and location to the barrier slots 36 as a prerequisite to practicing this invention; appropriate changes in the gin baler may be required to provide the proper spacing. How to make such changes is well within the skill of the art.)

Once the bale is in place, the side door 30 is swung shut and held forcibly closed by conventional toggle linkage, not shown, so that the bale is confined laterally between the door 30 and the barrier 34 and cannot expand laterally between the platens. The press cylinder is then activated, drawing the lower platen upward between the lateral constraints. As compression proceeds, the round bale corners are squared off, and as the original baling wires slacken they bow uniformly outward in the only available direction, i.e., through the slots 34. When the initial 45-inch height has been reduced to about 37 inches, the wires protrude sufficiently through the slots that they can be engaged from behind. At this point, the pulleys 50 are swung simultaneously by their arms 52 to a position between the wires and the barrier plate 34. The linear motor 56 then activated, moving the pulleys 50 away from the barrier and into engagement with the wires. Further movement creates substantial tension in the wires, and this tension is maintained as compression proceeds down to a bale height of about twelve inches, the wire portions on the top, bottom and left sides of the bale remaining straight.

Since the final wire length needed is forty inches less than the original length, wire bights of substantial length are formed by the end of the compression phase, as shown in FIG. 5*c*. These bights are severed, shortened and re-tied subsequently by the mechanisms described below, whereafter the re-tied wires are released, and the lower platen is withdrawn. As the bale expands back to a height of about 24 inches, the newly tied wire bights withdraw through the slots 36, and the wires ultimately become taut. The bale is then ejected through the open side door 30.

Figure 8:
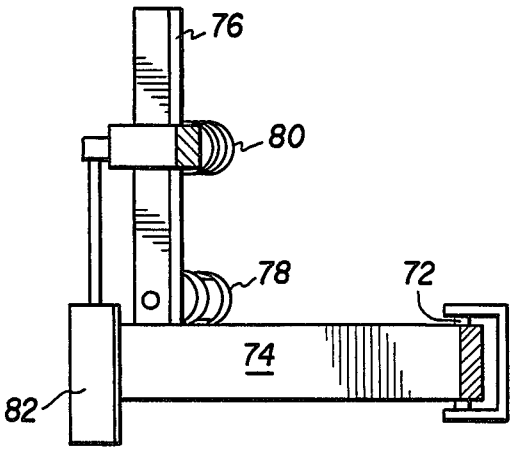
FIG. 8 illustrates a wire end aligning mechanism.
Figure 7:
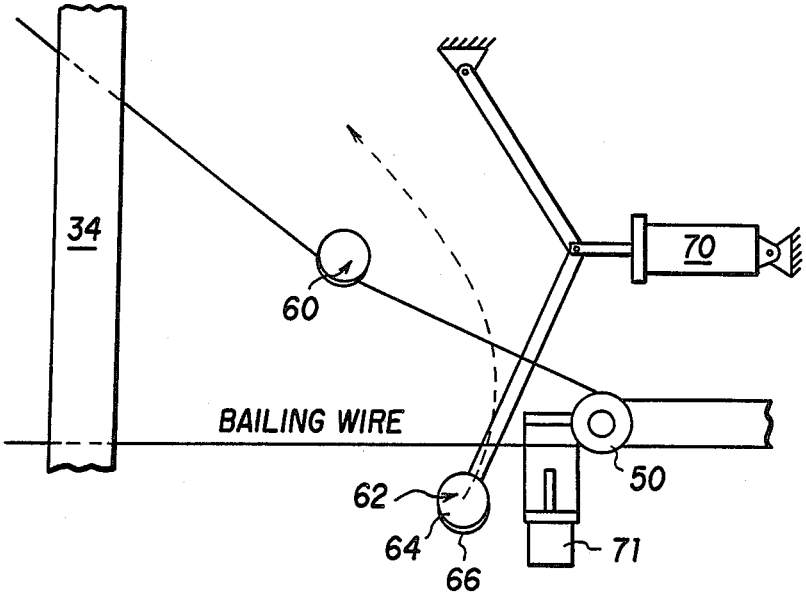
FIG. 7 is a detailed view of a wire clamping mechanism shown in FIGS. 5*a*–5*c;*
Figure 9:
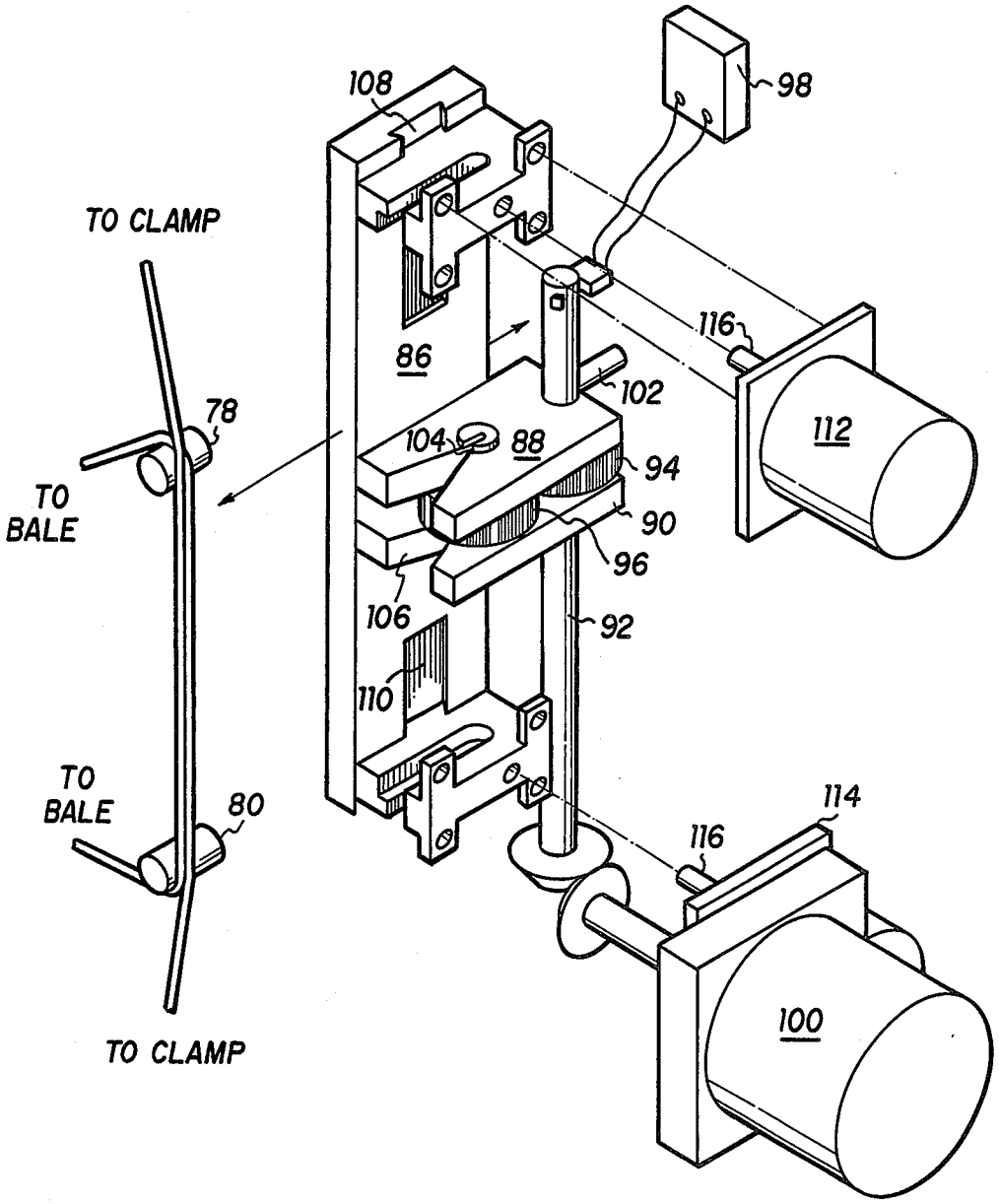
FIG. 9 shows the twist knot former portion of the apparatus.

Turning now to FIGS. 7–9, the apparatus further includes means for re-tying the original baling wires to a shorter than original length after the bale has been fully compressed. These means preferably include, for each baling wire, a pair of wire clamps for grasping the wire bight at two spaced points (FIG. 7), a wire cutter for severing the wire between the clamps, means for aligning the clamped wire ends so they can be twist-tied (FIG. 8), and means for forming a twist knot in the aligned end portions (FIG. 9). The drawings show these mechanisms for only one of the eight stations, which are identical and operate simultaneously.

The wire clamps 60, 62 shown in detail in FIG. 7 are conventional fluid-actuated items with reciprocable jaws 64, 66 that apply sufficient grasping force to prevent wire slippage after the bight is severed. The upper clamp 60 is stationarily located in the plane of the bale wire to which it corresponds; however, the lower clamp 62 may be moved upward within this plane by operation of a linear motor 70, whereby the lower wire end can be drawn around the reaction bars described below. A wire cutter 71 is positioned near one of the clamps as shown.

A reaction bar assembly is illustrated in FIG. 8. The assembly is supported by a vertical pivot 72, and includes a horizontal bar 74 with an upright spline 76 attached thereto. A first reaction bar 78 is fixed at the lower end of the spline, while a second bar 80, movably mounted on the spline, may be elevated or lowered by a fluid actuator 82. The reaction bars serve to align and locate the opposite clamped wire ends preparatory to the twist-tying step. All eight reaction bar assemblies are pivoted simultaneously by a common actuating mechanism (not shown) similar to the pulley pivot mechanism.

One of the eight twist knot formers 84 is illustrated in FIG. 9. The entire device is movable a small distance along the length of the bale, so that it can engage or disengage bale wires held in tension across the reaction bars. The knot former includes a frame 86 movably mounted on the press frame 10, and has two spaced horizontal plates 88, 90 affixed midway thereon. In these plates are journaled both a driveshaft 92 having a spur gear 94 thereon, and a tying pinion 96 meshed with the gear. The upper end of the shaft is associated with an electrical sensor 98 and circuitry for counting driveshaft turns. The lower end of the shaft is connected via suitable gearing, to a pneumatic rotary motor 100. An indexing mechanism 102, necessary to allow withdrawal of the twist knot from the pinion, is also provided.

The tying pinion 96 has a slot 104, approximately equal in width to the baling wire diameter, extending its complete length in a radial plane outward from its rotational axis. The indexing mechanism 102 referred to above establishes a rest position for the pinion slot to the left in FIG. 9. To facilitate insertion of the aligned wires into the pinion slot, each of the plates 88, 90 has a tapered notch 106 aligned with the pinion slot at rest.

The knot former frame 86 also has upper and lower dovetail slots 108, 110 which adjustably support respective pin-type wire cutters 112, 114. The two cutters, cutting pins 116 are offset in opposite directions, so that each severs only excess end wire when the cutter cylinders 118 are activated.

Operation of the devices shown in FIGS. 7–9 begins after the bale has been fully compressed (FIG. 5*c*). Note that the pulley 50 has drawn the baling wire bight into the jaws of the clamps 60 and 62 so that moving the clamps to the wire is unnecessary.

The reaction bar assembly shown in FIG. 8 is next pivoted so that its bars 78 and 80 come into position behind the upper portion of the wire bight, as shown in FIG. 9. The clamps 60 and 62, FIG. 7, are now closed, by the application of fluid pressure, around the wires, and the wire cutter 71 is activated to sever the wire between the clamps. With the wire ends now held in tension by the clamps, the upper reaction bar 80 (FIG. 9) is raised by operation of the actuator 82. Subsequently, the lower clamp 62 is raised along its track 68, shown diagrammatically in FIG. 7, until the wire ends are held adjacent one another against the reaction bars. The know former is moved leftward, by a traversing mechanism (not shown) so that the adjacent wires enter the pinion slot 104 via notches 106, and motor 100 is activated to rotate the pinion 96, twisting the wires held therein a predetermined number of turns until halted by the turns counter and the indexing mechanism. The cutter pins then operate to remove excess wire, now held by the clamps, and the knot former frame moves to the right to release the knot. Once the reaction bars are pivoted out of the way, the recompressed, re-tied bale may be released from the press as described above.

Inasmuch as numerous variations and modifications of the preferred embodiment will occur to those of skill in the art, the foregoing should be regarded only as illustrative of the invention, whose full scope is to be measured by the following claims.

What is claimed is:

1. A method of recompressing and re-tying a cotton bale comprising steps of:

placing a loose bale, with its original baling wires intact, in a press, laterally confining the bale while permitting outward bulging of the baling wires in one lateral direction, compressing the bale sufficiently to cause the baling wires to bulge away from the bale, engaging the bulged wire portions and applying tension to said portions is said direction away from the bale, compressing the bale to a desired final dimension while maintaining said wire tension, and then re-tying the original baling wires, under tension, so that the wires are shortened sufficiently to hold the bale in its compressed state.

2. The method of claim 1, wherein the re-tying step includes forming a twist-type knot in each of said wires.

3. The method of claim 1, further comprising steps of:

drawing each bulged wire portion into two spaced clamps;

applying adequate force to said clamps to prevent wire slipping therethrough;

drawing the clamped ends of said wire parallel to and adjacent one another against a spaced pair of bars; and performing said re-tying step on the wire portions extending between said bars.

4. The method of claim 3, wherein the re-tying step includes twisting the adjacent wire portions between said bars several turns about an axis parallel to the wire direction to produce a twist-type knot.

5. The method of claim 4, wherein each of said engaging, tensioning, clamping, drawing and re-tying steps is performed simultaneously on all baling wires on the bale.

6. An apparatus for recompressing and re-tying a cotton bale with its original baling wires intact comprising:

means for compressing the bale in one direction, a door for confining the bale on a first lateral side thereof against expansion in a direction transverse to said one direction, a barrier for confining the bale on a second lateral side thereof opposite said first lateral side, said barrier having therethrough a plurality of slots, corresponding in location and orientation to the baling wires, means for engaging and tensioning the baling wires as they protrude through said slots during bale compression, and means for re-tying the original baling wires, while under tension, to a shorter than original length suitable for retaining the bale in its substantially compressed state.

7. The apparatus of claim 6, wherein the original baling wires have a predetermined spacing on the loose bale and wherein said slots are parallel and regularly spaced at intervals corresponding to the spacing between baling wires.

8. The apparatus of claim 7, wherein said engaging and tensioning means comprises:

a plurality of pulleys, one for each baling wire, a like plurality of pulley arms, each pulley being mounted at one end of its respective arm for rotation about an axis transverse to its respective wire, a pulley arm support, all of said arms being pivotally connected to said support for rotation about axes parallel to said respective wires whereby said pulleys can be swung behind the wire portions bulging through said slots during compression of said bale, and means for moving the pulley support away from said barrier whereby the pulleys may engage the wires and maintain them under tension around the bale as it is compressed.

9. The apparatus of claim 7, wherein said re-tying means comprises, for each baling wire, a pair of clamps for grasping said wire at spaced points, a pair of spaced reaction bars transverse to said wire, means for severing a portion of wire between said clamps, means for moving said clamps, with wire ends secured therein, around said reaction bars in opposite directions so as to bring the wire ends parallel to and adjacent one another, and means for twisting said wires together along an axis parallel to said wire ends to form a twist knot therein.

10. The apparatus of claim 9, wherein said twisting means comprises:

a frame, a drive shaft journalled in said frame, a motor for driving said shaft, a gear affixed to said shaft, a pinion journalled in said frame and drivingly engaged by said gear, said pinion having a slot extending along a radial plane in one direction from the rotational axis of said pinion, said slot having a width approximately equal to the diameter of said baling wire, said frame further having a guide slot leading to the pinion slot when the pinion is in, one position of the pinion, means for counting the pinion rotation and halting such rotation after a predetermined number of turns, and means for bringing the pinion to rest opposite said guide slot whereby a knot formed by rotation of said pinion may be removed from the pinion slot.

* * * * *